US006658759B2

(12) United States Patent
Hu

(10) Patent No.: US 6,658,759 B2
(45) Date of Patent: Dec. 9, 2003

(54) NAIL DRYER

(76) Inventor: Hou-Chien Hu, 7F, No. 64, Lane 113, Tung Hu Road, Nei Hu District, Taipei (TW)

( * ) Notice: Subject to any disclaimer, the term of this patent is extended or adjusted under 35 U.S.C. 154(b) by 0 days.

(21) Appl. No.: 10/131,882

(22) Filed: Apr. 25, 2002

(65) Prior Publication Data

US 2003/0200977 A1 Oct. 30, 2003

(51) Int. Cl.[7] ..... F26B 25/06
(52) U.S. Cl. ..... 34/202; 416/63
(58) Field of Search ..... 132/73.5, 73.6; 34/96, 97, 98, 202; 416/63

(56) References Cited

U.S. PATENT DOCUMENTS 4,193,209 A * 3/1980 Lovison et al. ..... 34/202
4,255,871 A * 3/1981 Sigman ..... 34/202
5,130,551 A * 7/1992 Nafziger et al. ..... 34/202
5,133,043 A * 7/1992 Baugh ..... 34/202
5,468,124 A * 11/1995 Chen ..... 416/63
5,837,167 A * 11/1998 Lederer ..... 261/28
5,839,204 A * 11/1998 Cinque et al. ..... 34/97
5,873,178 A * 2/1999 Johnson ..... 34/97
6,192,702 B1 * 2/2001 Shimogori ..... 62/259.3
6,422,835 B1 * 7/2002 Beauchard ..... 417/411
2002/0006275 A1 * 1/2002 Pollack ..... 392/380
2002/0139382 A1 * 10/2002 Christianson ..... 132/75.6

* cited by examiner

*Primary Examiner*—Todd E. Manahan
(74) *Attorney, Agent, or Firm*—Alan D. Kamrath; Rider Bennett, LLP

(57) ABSTRACT

A nail dryer includes a housing for contacting a user's fingers and an air stream generation unit received in the shell for generation of air stream in order to dry nail polish on the user's nails. The housing defines a plurality of vents and a plurality of apertures. Air leaves the housing through the vents and enters the housing through the apertures. The housing includes two shells each defining a plurality of apertures. One of the shells includes a plurality of hooks formed thereon and the remaining one of the shells includes a corresponding number of recesses defined therein for receiving the hooks. The air stream generation unit includes a motor and a propeller connected with the motor. The motor is connected with a DC power supply through a circuit. The circuit includes a switch. The housing includes a seat on which the motor is mounted. The seat includes a plurality of plates projecting from one of the shells. Each of the plates of the seat includes an edge complementary to the motor.

18 Claims, 5 Drawing Sheets

NAIL DRYER

BACKGROUND OF INVENTION

1. Field of Invention

The present invention is related to a nail dryer.

2. Related Prior Art

Many ladies like to wear nail polish on their nails and more particularly finger nails for aesthetic reasons. However, it takes a long time for the nail polish to dry in the air naturally. Therefore, a lady has to waste considerable time waiting for the nail polish on her nails to dry. To avoid such waste of time, some nail dryers have been devised to expedite drying of the nail polish on nails.

Sometimes, ladies dry nail polish on their nails with a hair dryer. Use of the hair dryer to dry the nail polish requires some skills. If the hair dryer is positioned too far from the nail polish, a small portion of hot air sent from the hair dryer can contribute to the drying of the nail polish. If the hair dryer is positioned too close to the nail polish, the nail polish will be wrinkled by strong air sent from the hair dryer.

For example, Taiwanese Patent Publication No. 209346 discloses a conventional nail dryer that includes a handle extending from a shell. A light source that can emit ultra-violet light is installed in the shell. The shell defines a slot through which ultra-violet light emitted from the light source can spray. After wearing nail polish on her finger nails, a lady can hold the handle with her hand so that the ultra-violet light shines on her finger nails in order to cure the nail polish. This conventional nail dryer however may cause a problem on human health, i.e., the ultra-violet light may hurt a user's skin.

The present invention is therefore intended to obviate or at least alleviate the problems encountered in the prior art.

SUMMARY OF INVENTION

It is an objective of the present invention to provide a nail dryer that can expedite drying of nail polish on a nail.

It is another objective of the present invention to provide a nail dryer that can expedite drying of nail polish on a nail without wrinkling the nail polish.

According to the present invention, a nail dryer includes a housing for contacting a user's fingers and an air stream generation unit received in the shell for generation of an air stream in order to dry nail polish the user's nails.

The housing defines a plurality of vents and a plurality of apertures. Air leaves the housing through the vents and enters the housing through the apertures.

The housing includes two shells each defining a plurality of apertures. One of the shells includes a plurality of hooks formed thereon and the remaining one of the shells includes a corresponding number of recesses defined therein for receiving the hooks.

The air stream generation unit includes a motor and a propeller connected with the motor. The motor is connected with a DC power supply through a circuit. The circuit includes a switch.

The housing includes a seat on which the motor is mounted. The seat includes a plurality of plates projecting from one of the shells. Each of the plates of the seat includes an edge complementary to the motor.

Other objectives, advantages, and novel features of the invention will become more apparent from the following detailed description when taken in conjunction with the attached drawings.

BRIEF DESCRIPTION OF DRAWINGS

The present invention is described through detailed illustration of embodiments referring to the attached drawings wherein.

DETAILED DESCRIPTION OF EMBODIMENTS

Figure 1:
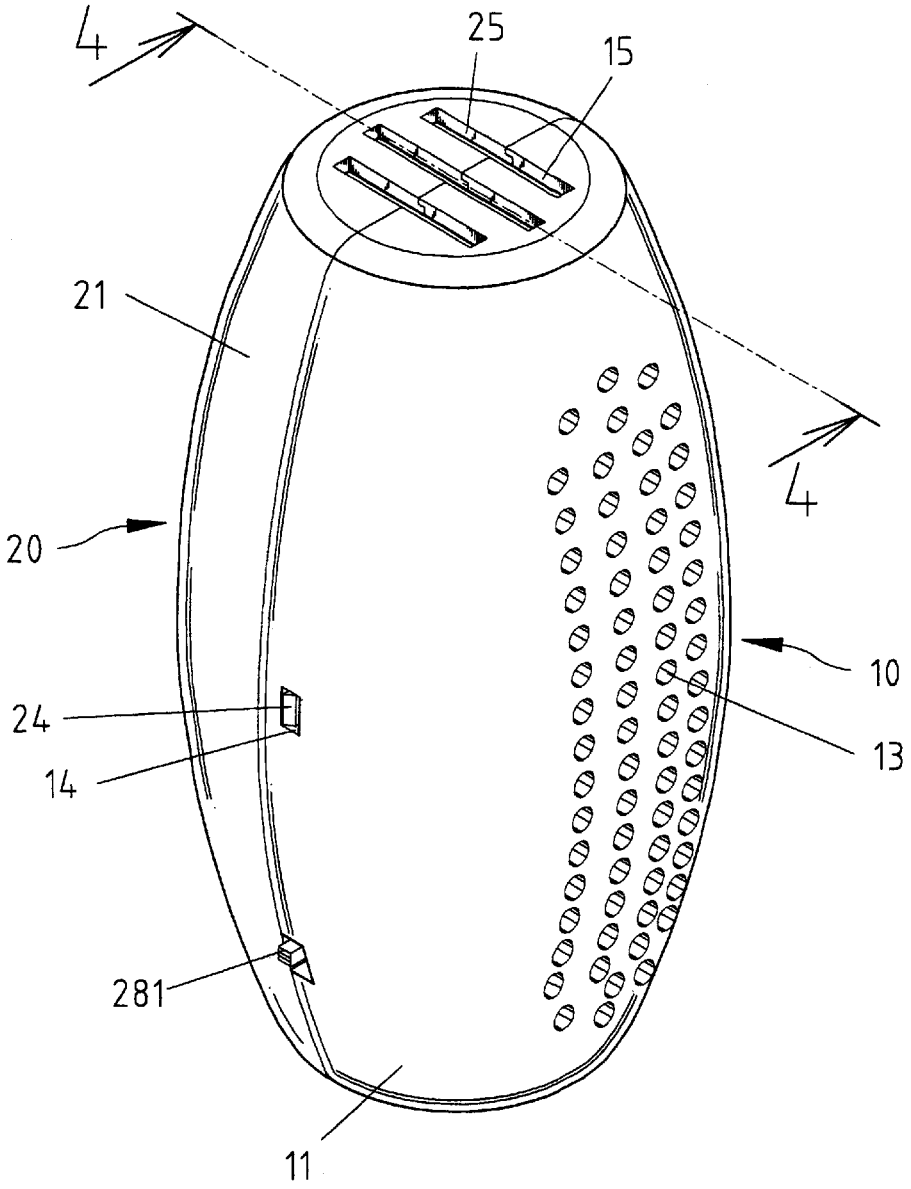
FIG. 1 is a perspective view of a nail dryer according to the present invention.
Figure 2:
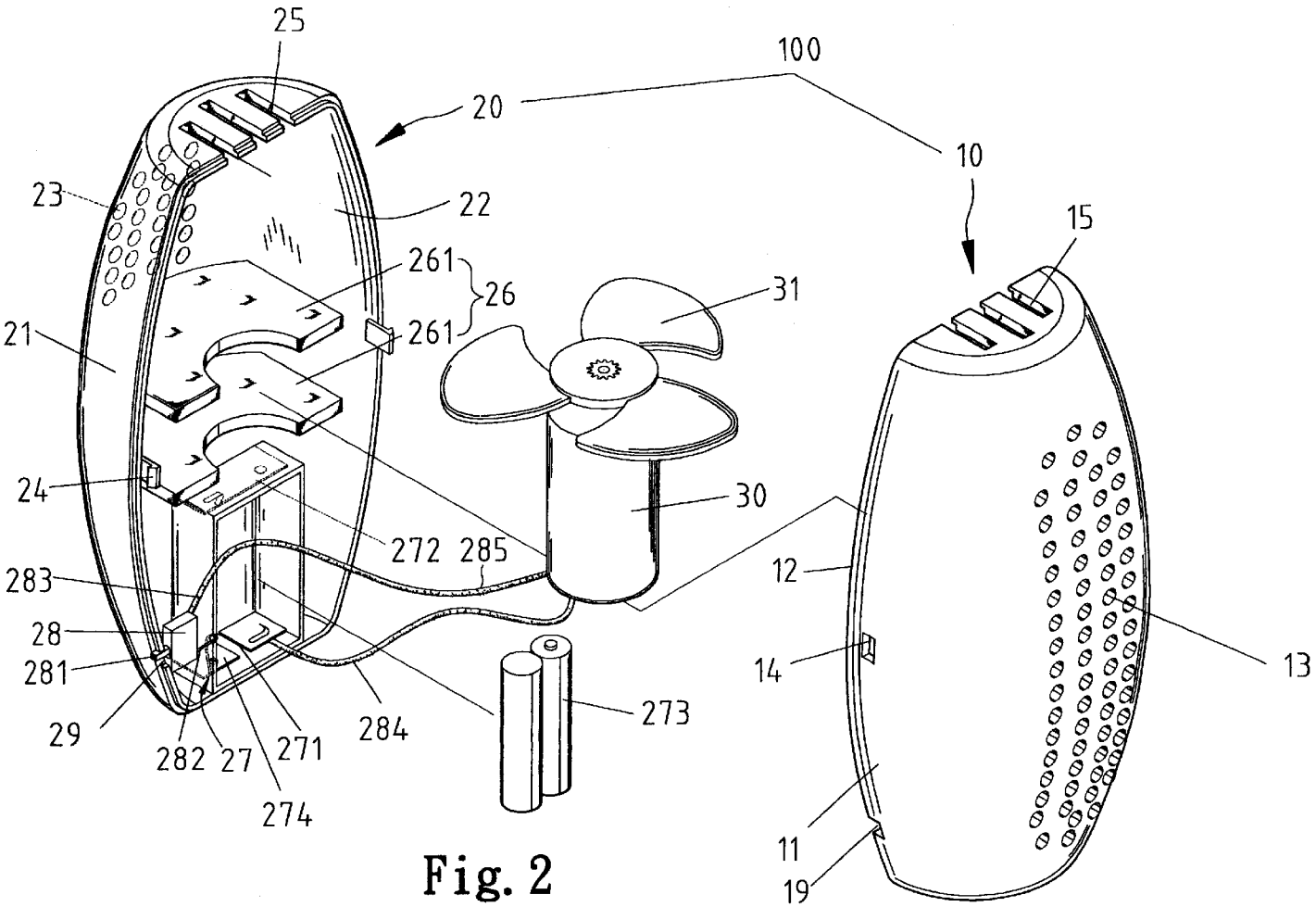
FIG. 2 is an exploded view of the nail dryer shown in FIG. 1.
Figure 3:
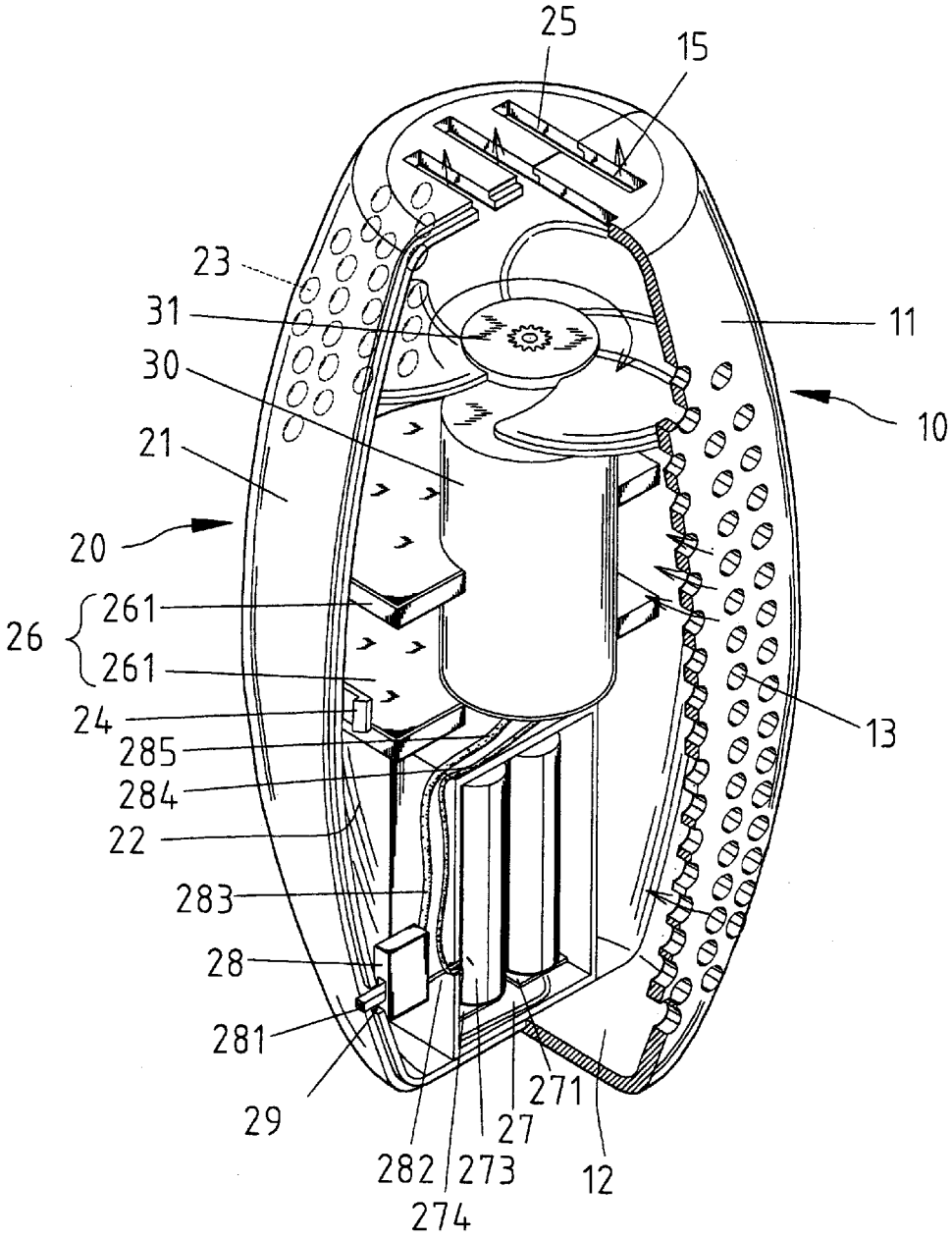
FIG. 3 is a perspective view of the nail dryer shown in FIG. 1 with a housing cut away so as to show elements contained in the housing.

Referring to FIGS. 1–3, a nail dryer according to the present invention includes a housing 100 for containing other elements. The housing 100 looks like an American football except for including two flat ends. The housing 100 is assembled from two shells 10 and 20 similar to each other in profile.

The shell 10 includes an external side 11 that is exposed when the shells 10 and 20 are engaged with each other and an internal side 12 that is concealed when the shells 10 and 20 are engaged with each other. The shell 10 defines a plurality of apertures 13 through which air can enter the housing 100. The shell 10 defines two holes 14 near an edge thereof. The holes 14 may be replaced with two recesses defined in the internal side 12. The shell 10 defines three slots 15 in one end thereof. The shell 10 defines a cutout 19 in the edge thereof.

The shell 20 includes an external side 21 that is exposed when the shells 10 and 20 are engaged with each other and an internal side 22 that is concealed when the shells 10 and 20 are engaged with each other. The shell 20 defines a plurality of apertures 13 through which air can enter the housing 100. The shell 20 includes two hooks 24 formed thereon near an edge thereof.

The shell 20 defines three slots 25 in one end thereof The shell 20 defines a cutout 29 in the edge thereof.

The shells 10 and 20 can be assembled. The holes 14 receive the hooks 24. As best seen in FIG. 1, the slots 15 and 25 together make longer slots that function as vents through which air leaves the housing 100. The cutouts 19 and 29 together make a hole to be described.

The nail dryer includes an air stream generation unit consisting of a motor 30 received in the housing 100 and a propeller 31 connected with the motor 30. The motor 30 can drive the propeller 31 to generate the air stream.

A seat 26 is formed on the shell 20. The seat 26 includes two plates 261 projecting from the internal side 22 of the shell 20. The plates 261 are shaped corresponding to a profile of the motor 30 so that the motor 30 can be stably mounted on the plates 261.

The motor 30 is connected with DC power supply 273 through a circuit. The DC power supply 273 consists of two batteries received in a box 27 formed on the internal side 22 of the shell 20. Two metal strips 271 and 274 are mounted on a wall of the box 27. A metal strip 272 is mounted on an opposite wall of the box 27. The circuit includes a switch 28, a wire 282 leading from the switch 28 to the metal strip 274, a wire 284 leading from the metal strip 271 to the motor 30 and a wire 285 leading from the motor 30 to a wire 283 leading from the switch 28. The circuit will not be further described in detail, because it is conventional and not the spirit of the present invention. The switch 28 includes a lever 281. The switch 28 is installed in the shell 10 so that the lever 281 extends through the hole made by the cutouts 19 and 29.

Figure 4:
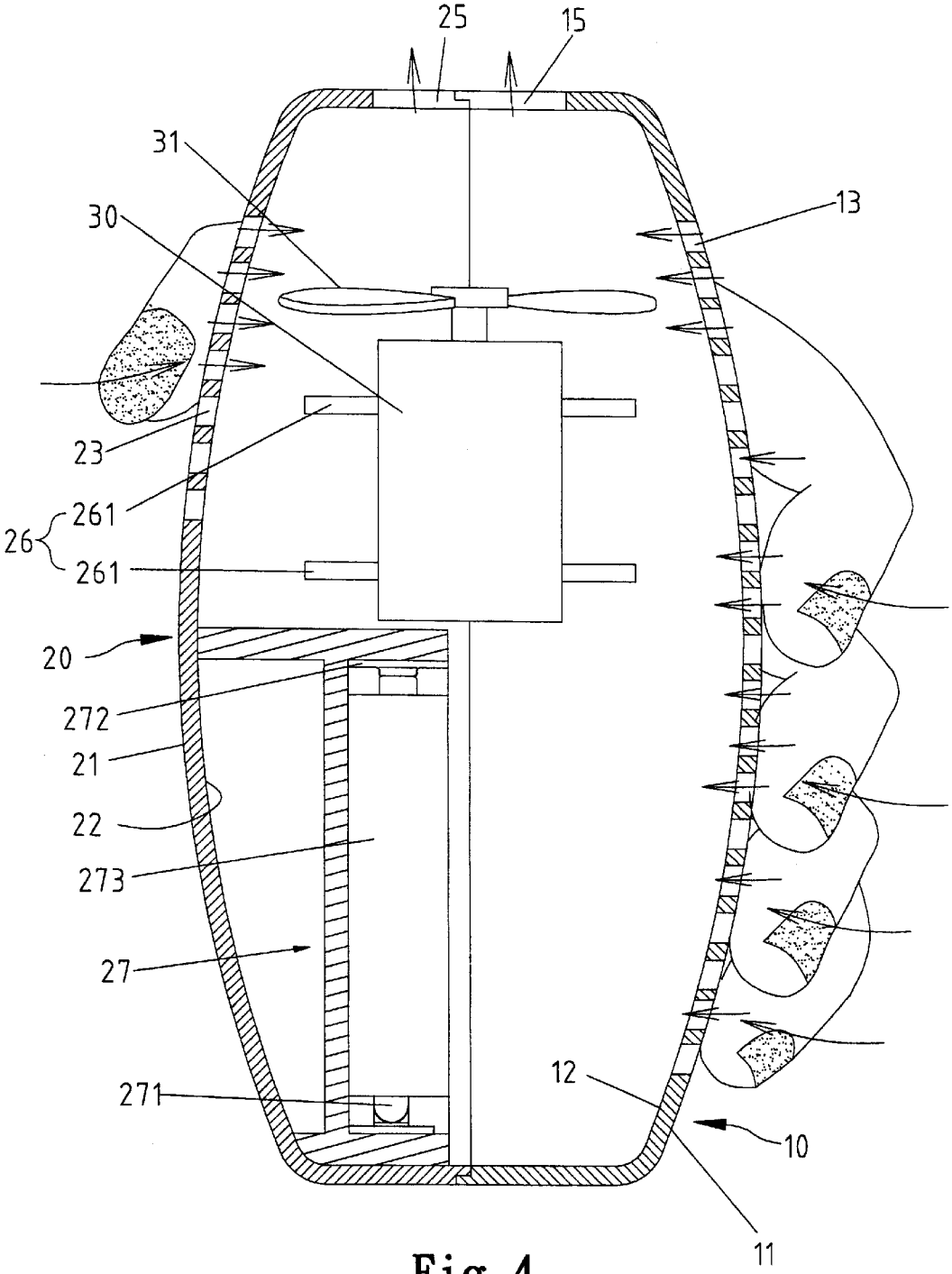
FIG. 4 is a cross-sectional view taken along a line 4–4 in FIG. 1.

Referring to FIG. 4, a user (not shown) can hold the nail dryer with one hand. The user's thumb contacts an area of the shell 20 in which the apertures 23 are defined while the other fingers contact an area of the shell 10 in which the apertures 13 are defined. The motor 30 drives the propeller 31 in order to expel air from the housing 100 through the vents made of the slots 15 and 25. This causes air to flow into the housing 100 through the apertures 13 and 23. This air stream is strong enough to expedite the drying of the nail polish and is soft enough not to wrinkle the nail polish.

Figure 5:
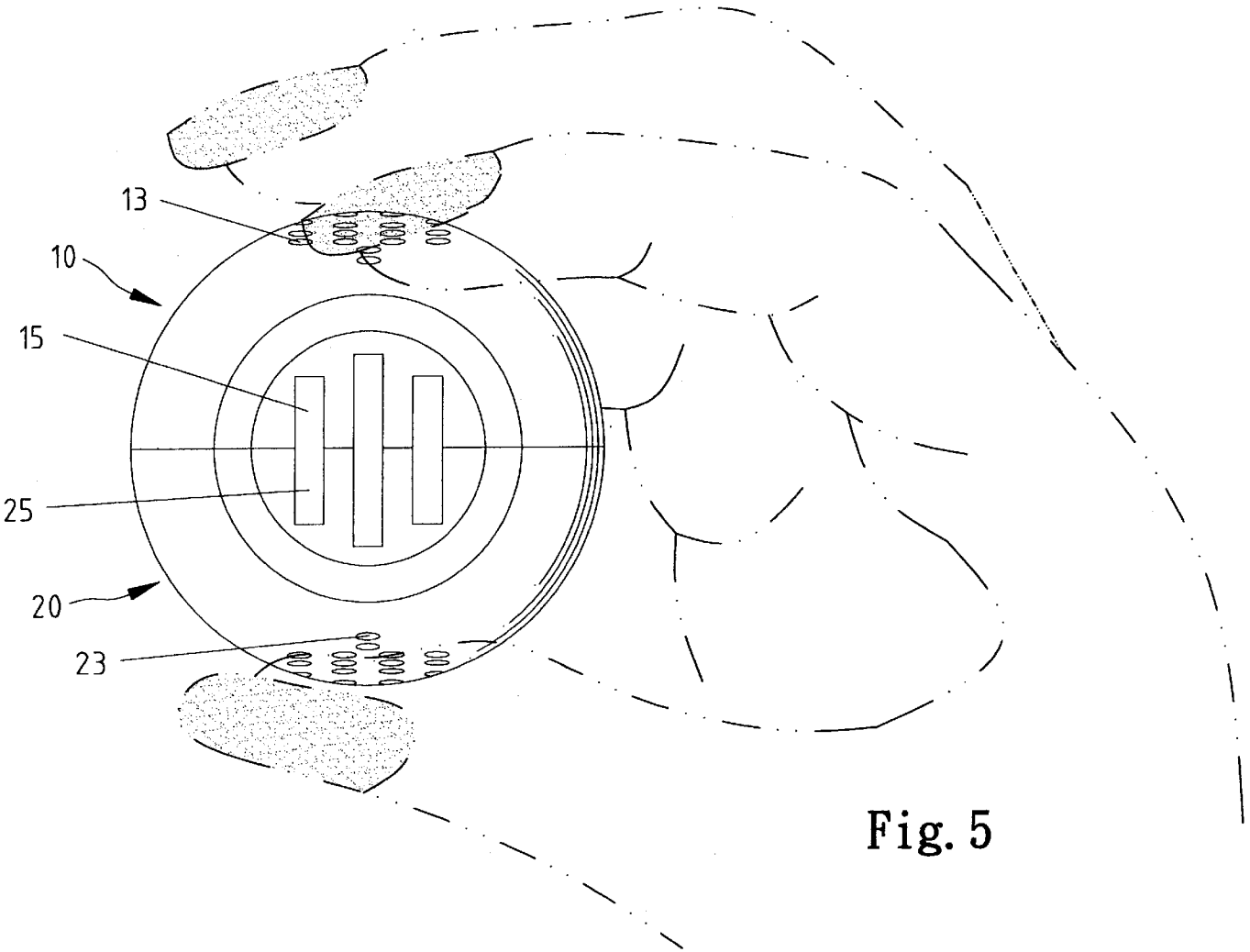
FIG. 5 is a side view showing another way to use the nail dryer shown in FIG. 1.

FIG. 5 shows another way to hold the nail dryer.

The present invention has been described through detailed illustration of the preferred embodiment thereof. Those skilled in the art can derive many variations from the preferred embodiment without departing from the scope of the present invention. Therefore, the preferred embodiment shall not limit the scope of the present invention. The scope of the present invention can only be defined in the attached claims.

What is claimed is:

1. A nail dryer including:

a housing including an external face adapted to contact a user's fingers and thumb, with the external face of the housing including a first side and an opposite side, with the opposite side being located generally opposite the first side, with the first side being adapted to contact pads of the user's fingers and with the opposite side being adapted to contact a pad of the user's thumb concurrent with contact of the user's fingers on the first side, with the housing adapted to be gripped and supported between the user's fingers and thumb, with the housing not requiring a support surface when gripped and supported by the user's fingers and thumb;

a first plurality of apertures located on the first side of the external face of the housing;

a second plurality of apertures located on the opposite side of the external face of the housing; and an air stream generation unit received in the housing generating an air stream drying nail polish on nails of the user's fingers contacting the first plurality of apertures of the first side of the external face of the housing concurrent with drying nail polish on a nail on the user's thumb contacting the second plurality of apertures of the opposite side of the external face of the housing as the housing is gripped and supported by the user's fingers and thumb.

2. The nail dryer according to claim 1 wherein the housing defines at least one vent, with the air stream generation unit generating the air stream leaving the housing through the vent and entering the housing through the first plurality of apertures and the second plurality of apertures after passing by the nails of the user's fingers and thumb gripping and supporting the housing to provide wrinkle free drying of nail polish by the air stream.

3. The nail dryer according to claim 2 wherein the housing includes two shells each defining one of the first plurality and the second plurality of apertures.

4. The nail dryer according to claim 3 wherein one of the shells includes a plurality of hooks formed thereon and the remaining one of the shells defines a corresponding number of recesses for receiving the hooks.

5. The nail dryer according to claim 3 wherein the air stream generation unit includes a motor and a propeller connected with the motor.

6. The nail dryer according to claim 5 wherein the housing includes a seat on which the motor is mounted, and the seat includes a plurality of plates projecting from each of the shells.

7. The nail dryer according to claim 6 wherein each plate of the plurality of plates of the seat includes an edge complementary to the motor.

8. The nail dryer according to claim 7 with the housing being internal to the user's fingers and thumb and defining a hollow interior, with the housing being free of pockets and removable features, and with the housing being free of projections and obstructions external to the user's fingers and thumb that could contact and mar wet fingernail polish when the housing is gripped and supported by the user's fingers and thumb.

9. The nail dryer according to claim 2 wherein the housing includes two shells each defining at least one cutout, wherein the at least one cutout defined in one of the shells matches the at least one cutout defined in the remaining one of the shells so as to make the at least one vent.

10. The nail dryer according to claim 2 wherein the air stream generation unit includes a motor and a propeller connected with the motor.

11. The nail dryer according to claim 10 wherein the housing includes a seat on which the motor is mounted.

12. The nail dryer according to claim 10 wherein the air stream generation unit includes a power supply for powering the motor.

13. The nail dryer according to claim 12 wherein the power supply is a DC power supply received in the housing.

14. The nail dryer according to claim 13 wherein the air stream generation unit includes a circuit for connecting the motor with the DC power supply.

15. The nail dryer according to claim 14 wherein the air stream generation unit includes a switch mounted on the housing.

16. The nail dryer according to claim 15 with the housing being internal to the user's fingers and thumb and defining a hollow interior, with the housing being free of pockets and removable features, and with the housing being free of projections and obstructions external to the user's fingers and thumb that could contact and mar wet fingernail polish when the housing is gripped and supported by the user's fingers and thumb.

17. The nail dryer according to claim 2 with the housing being internal to the user's fingers and thumb and defining a hollow interior, with the housing being free of pockets and removable features, and with the housing being free of projections and obstructions external to the user's fingers and thumb that could contact and mar wet fingernail polish when the housing is gripped and supported by the user's fingers and thumb.

18. The nail dryer according to claim 1 with the housing being internal to the user's fingers and thumb and defining a hollow interior, with the housing being free of pockets and removable features, and with the housing being free of projections and obstructions external to the user's fingers and thumb that could contact and mar wet fingernail polish when the housing is gripped and supported by the user's fingers and thumb.

* * * * *